United States Patent [19]

Murphy

[11] Patent Number: 4,843,937

[45] Date of Patent: Jul. 4, 1989

[54] ELECTRICAL SOUND DETECTOR FOR STRINGED INSTRUMENT

[76] Inventor: Robert T. Murphy, 455 Rte. 110, Melville, N.Y. 11747

[21] Appl. No.: 810,510

[22] Filed: Dec. 19, 1985

[51] Int. Cl.[4] ..... G10D 1/02; G10H 3/18

[52] U.S. Cl. ..... 84/1.16; 84/277; 84/DIG. 24

[58] Field of Search ..... 84/1.14–1.16, 84/DIG. 24, 274, 275, 277

[56] References Cited

U.S. PATENT DOCUMENTS

| | | | |
|---|---|---|---|
| 3,733,425 | 5/1973 | Chaki | 84/1.14 |
| 3,935,782 | 2/1976 | O'Brien | 84/1.16 |
| 4,242,938 | 1/1981 | van Zelinge | 84/1.16 |
| 4,532,847 | 8/1985 | Youngblood | 84/1.16 |

*Primary Examiner*—Stanley J. Witkowski

*Attorney, Agent, or Firm*—Bucknam and Archer

[57] ABSTRACT

An electrical detector attachment to the sound post of a stringed instrument is connected by an electric conductor to a coupling device adapted to receive at the exterior of the instrument the coupling member of an electronic device such as a sound amplifier.

5 Claims, 2 Drawing Sheets

ELECTRICAL SOUND DETECTOR FOR STRINGED INSTRUMENT

SUMMARY OF THE INVENTION

The nature and substance of the invention resides in an attachment for transmitting sound vibrations from the sound post of a stringed instrument such as a violin, viola, cello or double bass to a point on the exterior of said instrument where said attachment can be coupled to the input of an electronic device such as a sound amplifier.

Essentially, the attachment of the invention comprises a conductor, a modified sound post having one end of the conductor attached thereto, and a jack member connected to the other end of said conductor and extending outwardly from the instrument to permit coupling to the amplifier or the like. In a preferred embodiment, a modified end pin of the instrument serves as the jack member.

DRAWINGS

In order that the invention may be fully understood and readily carried into effect, reference is made to the accompanying drawings in which.

DETAILED DESCRIPTION

Figure 1:
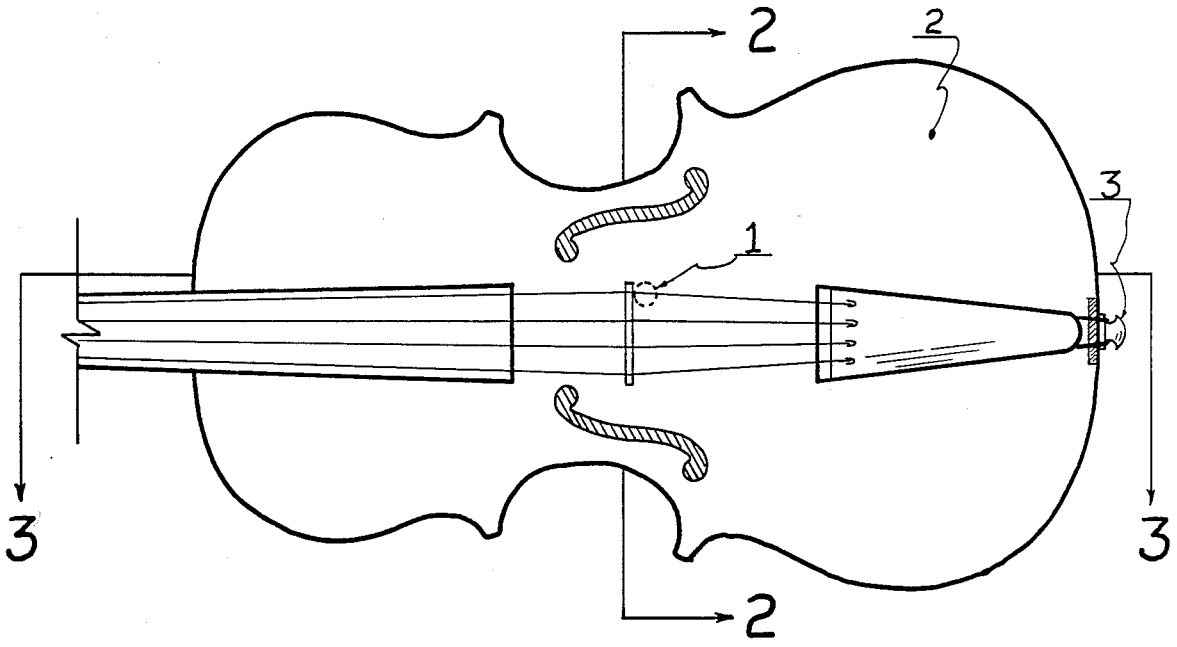
FIG. 1 is a top view of a violin with the neck cut away.

Referring to FIG. 1 there is shown a top view of a violin arbitrarily chosen as a typical example of the use of the invention. The sound post 1 whose end is shown as a dash circle lies immediately under the top plate 2 and extends vertically across the air space within. An end pin 3 normally serves as an attachment for the tail piece.

Figure 2:
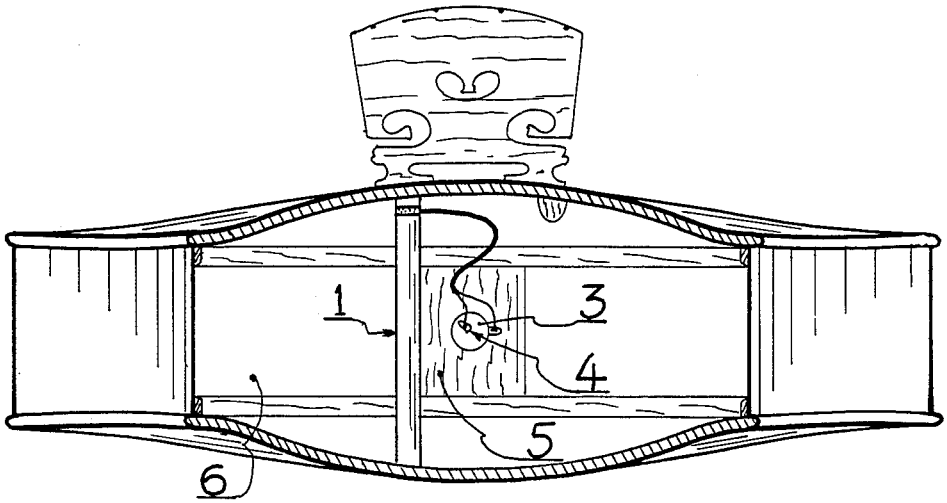
FIG. 2 is a sectional view along line 2—2 of FIG. 1.
Figure 3:
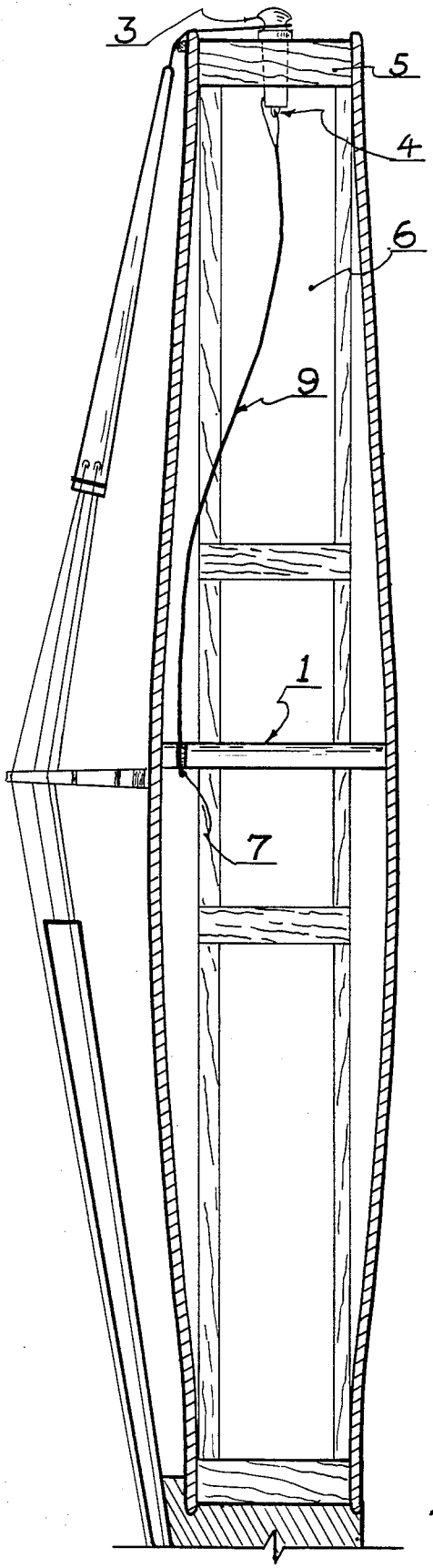
FIG. 3 is a sectional view taken along line 3—3 of FIG. 1.

In the preferred embodiment, end pin 3 is modified as seen in FIGS. 1, 2 and 3 to accommodate a jack member 4 of standard type to which the lead to a conventional sound reproducing device comprising an amplifier or the like may be attached. If desired, however, the end pin 3 may remain unmodified and a suitable jack member may be provided in another part of the instrument such as the conventional end block 5 or side rib 6.

Figure 4:
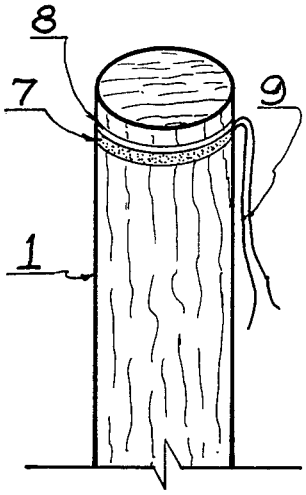
FIG. 4 is an enlarged perspective view of a segment of the sound post.

Referring to FIG. 4, the normal sound post 1 is shown as modified by having a flat piezo crystal 7 cemented therein to form a cross sectional wafer, and a mounting plate 8 is provided at the top thereof. A conductor 9 preferably in the form of a shielded wire is attached in known manner to crystal 7 and in the specific embodiment is attached to jack member 4 adjacent the inner end of end pin 3.

One simply plugs the amplifier or the like into jack member 4 and, due to the extreme sensitivity and high fidelity of the sound post vibration, a rich and full reproduction of the instrument's sound will be introduced into the amplifier.

I claim:

1. An attachment for a sound post type stringed instrument comprising a conductor, a sound post modified by having an electronic sound pick-up member mounted therein and also attached to one end of said conductor, and a jack member attached to the other end of said conductor and adapted to extend outwardly of the instrument for attachment to a conventional sound reproducing device.

2. An attachment according to claim 1 for an instrument of the type customarily having an end pin, wherein said jack member is formed to replace the customary end pin.

3. An attachment according to claim 1 in which said electronic sound pick-up member comprises a piezo electric device forming a cross sectional wafer in the sound post.

4. A stringed instrument of the type having a sound post, comprising a conductor, a modified sound post having an electronic sound pick-up member mounted therein and also attached to said conductor, and a jack member attached to the other end of said conductor and extending outwardly of the instrument for attachment to a conventional electronic sound reproducing device.

5. A method of transmitting sound to a conventional sound reproducing device from a stringed instrument of the type having a sound post, which comprises electronically picking up the vibration of said sound post through a piezo electric device mounted therein and transmitting the electronic signals thus derived to an output member accessible from the exterior of the instrument.

* * * * *